United States Patent [19]

Issler et al.

[11] 4,019,796

[45] Apr. 26, 1977

[54] SEPARABLE CONTACT AND CONNECTION ARRANGEMENT FOR IGNITION CABLES TO A FIXED TERMINAL, FOR EXAMPLE THE DISTRIBUTOR CAP OF A DISTRIBUTOR-BREAKER ASSEMBLY

[75] Inventors: Jörg Issler; Richard Gerber, both of Stuttgart, Germany

[73] Assignee: Robert Bosch G.m.b.H., Stuttgart, Germany

[22] Filed: Aug. 25, 1976

[21] Appl. No.: 717,528

[30] Foreign Application Priority Data

Sept. 10, 1975 Germany ..... 2540239

[52] U.S. Cl. ..... 339/12 R; 339/252 S

[51] Int. Cl.[2] ..... H01R 11/30

[58] Field of Search ..... 339/12, 14 R, 103 R, 339/111, 252 R, 252 S, 253 R, 253 S, 255 R, 255 RT

[56] References Cited

UNITED STATES PATENTS

| | | | |
|---|---|---|---|
| 1,852,190 | 4/1932 | Roe | 339/252 S |
| 2,487,098 | 11/1949 | Carington et al. | 339/252 S |

*Primary Examiner*—Roy Lake
*Assistant Examiner*—DeWalden W. Jones
*Attorney, Agent, or Firm*—Flynn & Frishauf

[57] ABSTRACT

To provide for reliable connection under conditions of extremes of shock and vibration, an axially acting contact spring is located between the movable electrode, typically connected to the wire, and the fixed electrode, then forming the connection in the distributor cap, the spring forming a current carrying contact element while exerting axially directed bias force; releasable holding means releasably, positively connect the cable and the socket of the distributor cap so that the spring can act as a resilient contact element. These releasable means may be either magnetic force means, a bayonet connection, a snap catch, or a collar fixed to the wire which is secured by a holder to the cap, the spring, in all instances, being interposed between the central connecting wire of the cable and the fixed terminal within the distributor cap.

19 Claims, 9 Drawing Figures

SEPARABLE CONTACT AND CONNECTION ARRANGEMENT FOR IGNITION CABLES TO A FIXED TERMINAL, FOR EXAMPLE THE DISTRIBUTOR CAP OF A DISTRIBUTOR-BREAKER ASSEMBLY

The present invention relates to a connection and contacting arrangement for ignition systems of internal combustion engines, and more particularly to a connecting arrangement for the ignition cables to the distributor cap of a distributor-breaker assembly.

The ignition cables are connected to the distributor cap both to provide high-voltage connection of the ignition coil to the central terminal as well as the separate connections from the distributor to the respective spark plugs. Customarily, the distributor cap is formed with extending bushing-like portions forming sockets for the distributor cables, in which a fixed sleeve-like socket element is secured which is electrically connected into the distributor. The movable electrode is formed by a cap attached to the cable and electrically connected with the wire therein. A separable connection of the two electrodes is provided by radial projections formed in the cap attached to the cable which engage in grooves formed in the sleeve of the distributor. This attachment system has proved reliable and is simple, and is suitable for most automotive vehicles and for internal combustion engines in connection therewith.

The connection system, as described and as customarily used does, however, lead to temporary malfunction and is not suitable for ignition systems of extreme reliability. Precise contact engagement of the movable and the fixed elements is not ensured; frequently, the only insurance against removal of one or the other cable is a rubber cap which holds the wire on the distributor and is actually provided to keep out dust, dirt and contamination. This is not, however, a reliable attachment of the electrical portion of the cable to the fixed contact terminal in the distributor.

It is an object of the present invention to provide a readily separable terminal arrangement for distributor caps and cables in which reliable electrical connection between the distributor wire and the fixed terminal in the distributor cap is ensured.

SUBJECT MATTER OF THE PRESENT INVENTION

Briefly, an axially acting contact spring is located between the movable electrode, typically the wire in the ignition cable, and the fixed electrode, and forms an current carrying contact means, while exerting axially directed bias force. The cable itself is held in the distributor cap or, rather, in the socket formed therein, by a releasable, positive connecting means. Preferably, the end of the cable is spaced from the fixed contact, the space being taken up at least in part by the contact spring to provide for reliable electrical connection and permit attachment of the cable to the distributor housing or, rather, to the distributor cap, while allowing for vibration of the cables and the cap, independently of each other.

The arrangement is simple, reliable and requires only few parts or elements which can readily be made in a way that there are no components which can get lost or severed, while providing for reliable electrical connection between the high voltage carrying conductor of the ignition cable and the respective terminal.

The invention will be described by way of example with reference to the accompanying drawings, wherein.

Figure 1:
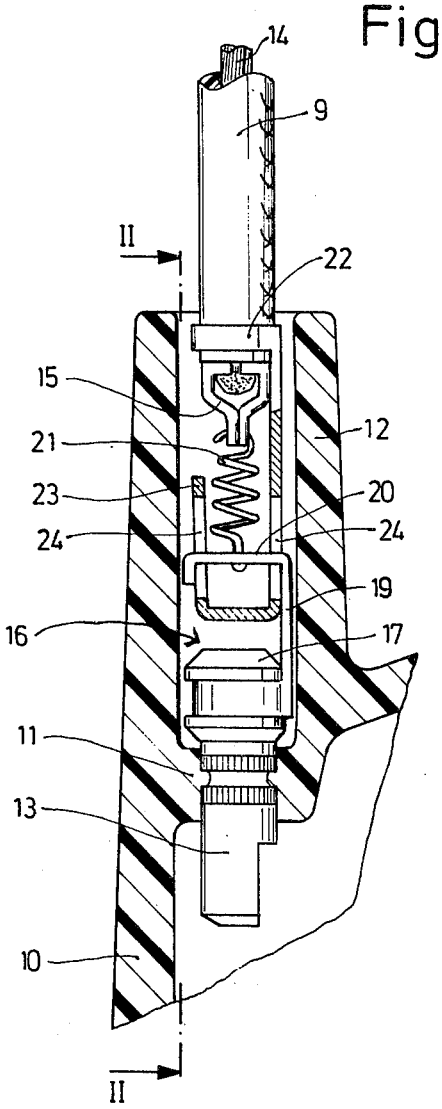
FIG. 1 is a fragmentary longitudinal sectional view through the cap of a distributor, showing a contacting arrangement utilizing a magnet.

The distributor cap 10, which may be of standard construction and is shown therefore only in fragmentary outline, carries a terminal 13 molded or pressed into a constriction 11. Terminal 13 is made of steel. Ignition cable 9 has an insulating jacket and a central wire 14. A holding bail 15 is held by the end of the wire 14, for example by being soldered thereto, crimped thereover, or otherwise reliably secured both electrically as well mechanically.

In accordance with the present invention, the movable electrode is a bolt or button-shaped permanent magnet element 16 which, at its ends, merges into conical sections 17 (FIG. 2) which project beyond a relieved central groove. A holding element 19 is formed with two projecting fingers 18 which overlap and fit into the groove between the end portions 17 of the magnet 16. The holding element 19 terminates at its upper end in a bent-over portion 20, formed as a hook and having an enlarged outer end to form a slide member.

Figure 3:
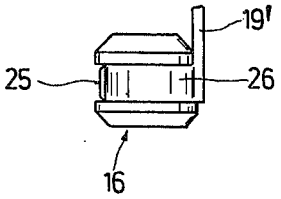
FIG. 3 is a schematic front view of a portion of the arrangement of FIG. 1, and illustrating another embodiment thereof.

A contact spring 21, formed as a spiral tension spring, is hooked into bail 15 at one end and over the hook 20 at the other. Spring 20 thus provides an axially acting force between the central conductor 14 of the ignition cable 9 and the fixed electrode 13 by engaging holder 19 which is also clamped to the permanent magnet 16. A cable sleeve 22 is clamped to the end portion of the cable 9. Cable shoe 22 is extended to form a counter guide element 24, shaped as a hook 23 and formed with an opening in which the end portion of the hook 23 of the holder 19 for the permanent magnet 16 is slidably engaged. Contact spring 21 can, therefore, move the holder 19 up and down in openings formed in the holding hook 23 extending from cable 9 in axial direction with respect to the cable 9. FIG. 3 illustrates another embodiment in which, instead of the projecting fingers extending from holder 19, a sleeve 26 is attached to a holder portion 19' and squeezed at 25 to reduce its diameter and to seat the sleeve in the groove of magnet 16.

Operation — and Contact Connection

In non-connected condition, that is, before the cable is assembled to the distributor, spring 21 pulls the holder 19 (or 19', respectively) together with magnet 16 up to the end stop of the hook 24. Cable 9 is then introduced in axial direction into the socket 12 of the insulating portion 10 until the magnet 16 engages the electrode 13 and, by magnetic force, sticks thereto. Thus, the two electrodes are connected by the magnet 16, holder 19, or 19', respectively, spring 21 and connection bail 15. The contact connection can be severed by pulling cable 9 outwardly from the socket 12. This pulling force is first accepted by the spring 21 until magnetic attraction force is exceeded, at which point the magnet will snap away.

The electrodes come in reliable contact already upon approach. To sever the electrodes, however, a predetermined force must be definitely exerted. Should, due to extreme vibration, the cable 9 be pulled slightly away, the pull-away force would be substantial; the spring 21 will have a force which is less than the attractive force of the magnet 16.

Figure 4:
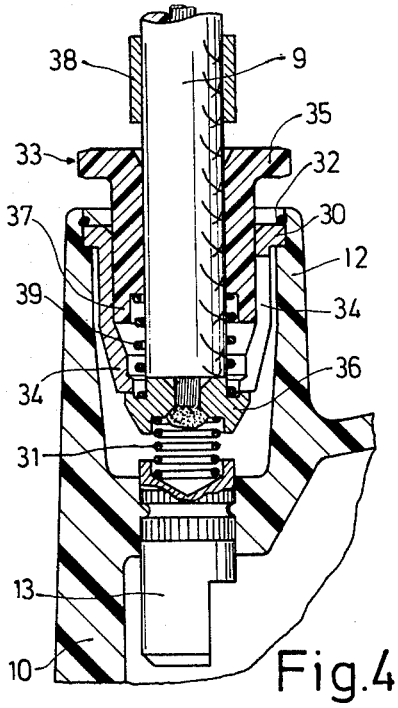
FIG. 4 is a fragmentary sectional view through the cap of the distributor illustrating a snap-lock connection.

Embodiment of FIG. 4: The cable is held in position by a snap connection which, essentially, consists of a spreader element 30 and a release sleeve 33.

The spreader element 30 is made of resilient material. It has a flange at the outer side and is secured by means of a C-ring 32 in the bushing or socket extension 12 of the distributor 10. The spreader element 30 has a plurality — preferably not less than three — spreading jaws or tongues 34 which extend downwardly into the socket 12. A sleeve 33, for example of plastic molding and having an outer flange 35, is longitudinally slidable with respect to the cable 9 and slipped thereover. The end of the cable 9 is stripped and a terminal washer 36 is set therein, secured to the wire 14 of the cable 9, as shown in FIG. 4, and preferably attached by wire spreading, mashing-over and/or soldering. A compression spring 39 is introduced between the sleeve 33 and the washer 36. The contact spring itself is a spiral compression spring 31 which is seated in a recess formed in the washer 36. To ensure that the spring 31 cannot be lost, washer 36, after the spring is seated therein, can be slightly deformed to crimp the spring into the recess. Spring 31 effects the connection; preferably, the upper end of terminal 13 is relieved to form a seat for spring 31, as shown in FIG. 4, or has a small contact washer inserted therein. A sleeve 38, for example clamped or crimped over cable 9, limits upward movement of the sleeve 33 and ensures against loss thereof.

Connection and operation: The sleeve 30, with the spreader tongues 34, is introduced into the socket of the distributor cap 10. Cable 9, with washer 36 and spring 31 attached, is then axially introduced into the socket, the washer 36 spreading the tongues 34 radially outwardly until washer 36 is passed, whereupon the tongues 34 will snap radially inwardly. The electrode washer 36 is now axially fixed; spring 31, guided in the recess of washer 36 and, preferably, also in the recess of terminal 13, provides for reliable electrical connection.

To sever the connection, sleeve 33 is pressed downwardly counter the force of spring 39 until the tongues 34 have been sufficiently spread radially outwardly to release electrode 36. Spring 31 will then snap the cable 9 outwardly and eject the cable, thus severing the terminal. Spring 39 then returns the sleeve 33 to the position shown in FIG. 4 and prevents possible undesired spreading of the tongues 34.

Figure 5:
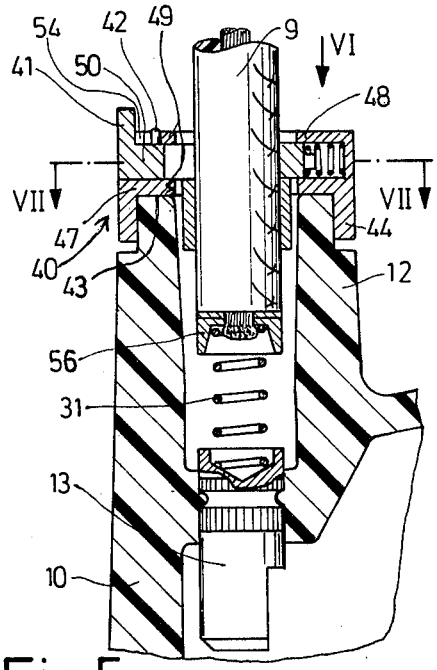
FIG. 5 is a fragmentary sectional longitudinal view through the cap of a distributor illustrating another embodiment of the invention.
Figure 6:
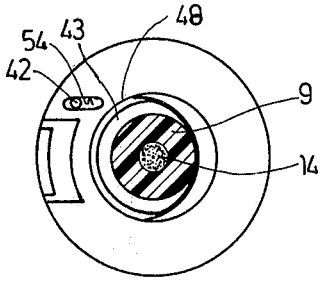
FIG. 6 is a fragmentary top view in the direction of the arrow VI of FIG. 5, in which the ignition cable is shown cut.
Figure 7:
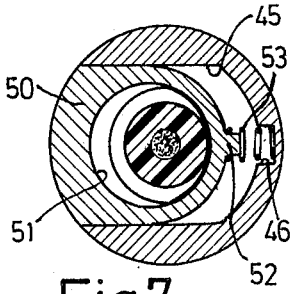
FIG. 7 is a horizontal sectional view along line VII—VII of FIG. 5.

Embodiment of FIGS. 5–7: The connection of the cable to the fixed terminal is a clamping connection. In general, it consists of a cover 40 secured to the insulating socket 12 of the distributor cap 10, a slider 41 slidable transversely to the axial direction of the cable 9, and a holding sleeve 43 secured to the outside of cable 9.

The cover 40 has an overlapping downwardly extending collar 44 which is secured to the outer circumference of the socket 12 of the insulator 10. The cover 40 is formed with a slide surface 45, in transverse section of rectangular shape, and has, further, a radially extending blind bore 46. The cover, therefore, forms a lower plate 47 and an upper plate 48. A central bore 49 extends through both the lower and the upper plates 47, 48.

The slider 41 has a tongue 50 with an opening 51 of a diameter slightly larger than the outer diameter of cable 9. The inner end of the tongue is formed with a small projection 52 on which a spring 53 is secured which fits into the blind bore 46. The upper plate 48 of the cover 40 is formed with a longitudinal slit 54, in the direction of movement of the slider 41. A pin 42 extends from slider 41 and is engaged in the slit 44 in order to limit sliding movement of the slider and ensuring its position in the cover so that it cannot get lost. A sleeve-like abutment element 43, having an outer diameter slightly smaller than the diameter of the bore 49, is secured to the outside of cable 9. The cable is stripped and a contact washer 56 attached thereto and electrically connected to the wire 14 within cable 9. Contact spring 31 is interposed between washer 56 and the terminal 13, for example similar to the arrangement described in connection with FIG. 4.

Operation and Connection

Slider 41 is depressed against the force of spring 46. Electrode spring 31, crimped or otherwise connected to the terminal washer 56 and attached to the cable, is introduced into the socket 12. The cable 9 is introduced through the cover 40 until the abutment sleeve 43 has passed the tongue 50 of the slider 41. Thereafter, slider 41 is released so that spring 53 can push it into the quiescent position shown in FIGS. 5 and 7. Slider 41 will then engage the abutment sleeve 43, axial pressure of the spring 31 pushing the sleeve 43 against the slider 41, while providing reliable electrical connection. To disassemble the wire from the seat, the slider 41 is pressed into the cover 40 until the tongue 50 releases the sleeve 43 so that the cable 9 is ejected by the force of the spring 31 or can be pulled out.

Figure 8:
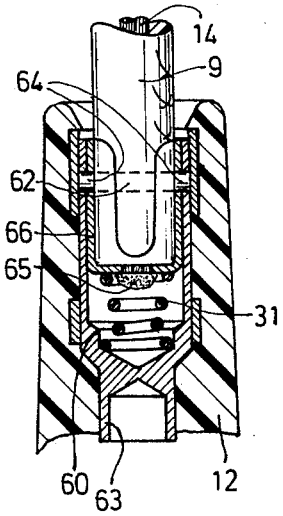
FIG. 8 is a fragmentary longitudinal sectional view through the socket of a distributor connection illustrating a bayonet connector.
Figure 9:
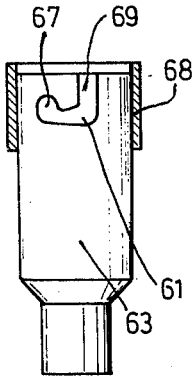
FIG. 9 is a side view of the socket element of FIG. 8.

Embodiment of FIGS. 8 and 9: The cable 9 is held in position by a bayonet connection. The movable electrode is connected to a contact sleeve 66 (FIG. 8) through which the wire 14 of the cable is passed. The cable is then electrically connected to the sleeve 66, for example at a solder connection 65. A transverse pin 62 pressed through sleeve 66 and having two extending projecting ends 64 provides for bayonet-like engagement with a socket element secured in the socket 12.

A socket element 63 is secured within the socket 12 of the distributor cap. It is formed with two bayonet-like engagement grooves 61 having a longitudinal portion 69 and a snap-in portion which is slightly enlarged, as seen at 67. A ring 68 is connected to the outer circumference of the socket element 63, for example by shrinking it on the socket 63. Contact spring 31 engages in the bottom of the socket 63 — see FIG. 8 — and is secured therein, for example by deformation of a portion of the interior of the socket.

Operation and Connection

The two electrodes 66, 63 are connected as well known in bayonet fasteners; they are axially guided to each other and the projecting pins 64 are engaged with the longitudinal portion 69 of the socket element 63 compressing spring 31. The cable is then twisted until the projections 64 engage in the enlarged opening 67 where they are reliably held by the spring 31. To release the cable, the operation is reversed.

The contact connection as described provides for reliable electrical and mechanical connection, while permitting severing the connection if desired. When using the embodiment of FIGS. 1–3, magnetic force is provided which ensures reliable contact even if substantial shock or vibration is incurred. The cable can be removed readily; severing of the contact is simple since the spring constant of spring 21 can be matched to the holding force of the magnet to provide for optimum release force.

The embodiment of FIG. 4 provides for precise longitudinal alignment and location of the fixed electrode with respect to the movable electrode; the contact spring 31 interposed between the two electrodes thus is uniformly stressed and the contact connection is reliable, even under highest vibration or shock loading. The forced contact connection to a longitudinally engaged pressure element is particularly advantageous under such conditions, the longitudinal element either reliably ensuring position of the movable electrode or severing of the contact.

The embodiment of FIGS. 5 to 7 likewise provides for a predetermined distance of the fixed electrode and the movable electrode when the contact is engaged. The unambiguous movement of the slider into engaged position, possible only when the collar 43 surrounding the cable 9 is below the slider, reliably ensures a good contact, even under conditions where the engagement point is difficult to see or to reach, which occurs in many automotive installations.

The bayonet connection of FIGS. 8 and 9 is particularly simple and reliable with respect to vibration, shock and other foreign movement; spurious removal of any one of the ignition cables is reliably prevented.

In the foregoing specification and drawings, reference has been made particularly to the distributor, distributor socket and distributor cap. The connecting socket of ignition coils and similar, generally, to the distributor cap sockets, can be similarly connected and should be deemed to be included within the term "cap" as used herein, although the general reference in the drawing has been directed to the distributor end of the ignition cable.

Various changes and modifications may be made and features described in connection with any one of the embodiments may be used with any one of the others, within the scope of the inventive concept.

Figure 2:
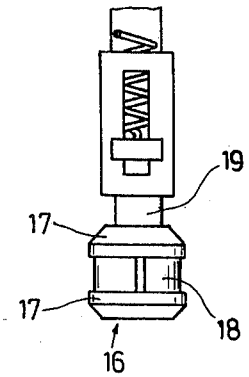
FIG. 2 is a side view taken along the arrows II—II of FIG. 1.

We claim:

1. Severable contact and connecting arrangement for ignition cables with fixed terminals having an ignition cable (9), a wire (14) within the cable and forming a movable electrode in the arrangement;

a socket (12) and a fixed electrode (13, 63) located therein and forming a fixed electrode of the arrangement, the movable electrode being axially insertable in the socket for engagement with the fixed electrode, comprising, in accordance with the invention, an axially acting contact spring (21, 31) located between the movable electrode and the fixed electrode and forming a current carrying contact means while exerting axially directed bias force between said elements;

and releasable holding means (FIGS. 1–3: 16; FIG. 4: 30, 34, 36; FIGS. 5–7: 40, 41, 43; FIGS. 8–9: 64, 61, 67) releasably positively connecting the cable and the socket, whereby the electrical connection is spring-loaded to effect positive contact even under severe vibration and shock conditions while releasably securing the cable in the socket.

2. Arrangement according to claim 1, wherein (FIGS. 1–3) a permanent magnet (16) is provided secured to the movable electrode;

a holder (19) secured to the permanent magnet (16);

and wherein the contact spring comprises a spiral tension spring (21) secured, respectively, to the holder (19) and to the wire (14) of the cable (9) to resiliently connect the holder, and hence the permanent magnet to the wire (14) of the cable, the permanent magnet being magnetically engageable with the fixed electrode (13).

3. Arrangement according to claim 2, further comprising a cable terminal element (22) connected to the end portion of the cable (9), a hook (23) formed on the cable terminal element, the holder (19) secured to the permanent magnet (16) being slidably engaged with respect to the hook for longitudinal movement in axial direction with respect to the cable.

4. Arrangement according to claim 2, wherein the holder (19) has two projecting prongs or fingers (18), the magnet (16) is a cylinder-shaped element, the prongs or fingers (18) surrounding the cylinder.

5. Arrangement according to claim 4, wherein the holder (19) is formed with an extending sleeve;

the magnet (16) is a cylindrical element, the sleeve being secured around the cylindrical element.

6. Arrangement according to claim 4, wherein the prongs or fingers (18) form a resiliently closable eye surrounding the cylindrical magnet (16).

7. Arrangement according to claim 4, wherein the cylindrical magnet is in the shape of a cylindrical button having chamfered end surfaces (17) to facilitate assembly to the holder (19).

8. Arrangement according to claim 1, wherein (FIG. 4) the holding means comprises a snap connection resiliently holding the cable (9) in a predetermined position with respect to the fixed electrode (13), the contact spring (31) being a spiral compression spring located between the cable (9) and the fixed electrode (13);

wherein the snap connection includes resiliently radially spreadable fingers (34) secured to the socket (12), an end washer (36) secured to the movable electrode and having a diameter larger than the diameter of the spreading fingers when in rest or snapped-together position, whereby, upon introduction of the cable with the washer through the fingers, the washer will spread the fingers and, upon passage therebeyond, the fingers will snap behind the washer and hold the washer and hence the cable in position against the force of the compressed spring (31).

9. Arrangement according to claim 8, wherein the spreading fingers are formed as a spreader element (30) inserted into the socket (12).

10. Arrangement according to claim 8, further comprising an expansion slider (33) formed as a sleeve and surrounding the cable, and movable into and out of spreading engagement with the spreading fingers (34) to radially spread the fingers outwardly after insertion of the cable into the snap connection, to permit release of the cable by spreading the fingers radially outwardly.

11. Arrangement according to claim 10, further comprising a spring (39) located between the washer (36) and the expansion slider.

12. Arrangement according to claim 11, further comprising a limit sleeve (38) secured around the cable and limiting axial movement of the expansion slider.

13. Arrangement according to claim 1, wherein (FIGS. 5 to 7) the releasable holding means comprises clamping means (40, 41) secured to the socket (12) and engageable with the cable, the contact spring being a compression spring introduced between the movable and the fixed electrodes.

14. Arrangement according to claim 13, wherein the clamping means comprises an insulating cover (40) secured to the socket (12), and a slider (41) movable transversely to the axial direction of the cable when inserted into the socket, the slider and the cover being formed with an opening larger than the cable;

and an abutment element (43) clamped to the outside of the cable (9) and positionable below the slider whereby, when the compression spring (31) is inserted between the electrodes, the abutment element will be retained in position below the slider (41) and hence hold the cable and the electrodes in position.

15. Arrangement according to claim 14, further comprising interengaging projection-and-recess means (42, 54) respectively formed on the slider (41) and on the cover (40) to limit movement of the slider with respect to the cover and to secure the slider, movably, within the cover and prevent loss thereof with respect thereto.

16. Arrangement according to claim 1, wherein (FIGS. 8, 9) the releasable holding means comprises a bayonet connection, one of the electrodes being formed as a cap (66), and projecting means (64) formed thereon, the other electrode being formed as a socket sleeve (63) with a bayonet groove (61, 67, 69) therein.

17. Arrangement according to claim 16, wherein the cable (9) has the cap secured thereon and the wire (14) is electrically connected thereto;

a pin (62) being passed through the cable (9) and projecting beyond the circumference of the cap (66) to form said projections (64), located diametrically across the wire;

and wherein the socket sleeve (63) is secured to or forms the fixed electrode located in the socket (12) and is formed with two L-shaped bayonet connection grooves or notches.

18. Arrangement according to claim 16, wherein the spring (31) comprises a spiral compression spring located between the sleeve (66) and the bottom (60) of the socket (63).

19. Arrangement according to claim 17, wherein the bayonet connection is an L-shaped notch, and a ring (68) is provided surrounding the socket (63) in the region of the notch to reinforce the socket.

* * * * *